United States Patent [19]

Tsukada et al.

[11] 4,222,776

[45] Sep. 16, 1980

[54] ELECTROPHOTOGRAPHIC METHOD

[75] Inventors: Syusei Tsukada, Tokyo; Yujiro Ando, Yokohama; Hiroshi Tanaka, Tokyo, all of Japan

[73] Assignee: Canon Kabushiki Kaisha, Tokyo, Japan

[21] Appl. No.: 760,855

[22] Filed: Jan. 21, 1977

Related U.S. Application Data

[63] Continuation of Ser. No. 317,783, Dec. 22, 1972, abandoned.

[30] Foreign Application Priority Data

Dec. 30, 1971 [JP] Japan ..... 47/1482

[51] Int. Cl.[2] ..... G03G 13/02; G03G 13/14; G03G 13/24

[52] U.S. Cl. ..... 430/55; 355/3 R; 355/3 CH; 430/100; 430/126

[58] Field of Search ..... 96/1 LY, 1 R, 1.4, 1 TE, 96/16; 427/17

[56] References Cited

U.S. PATENT DOCUMENTS

| | | | |
|---|---|---|---|
| 2,904,431 | 9/1959 | Moncrieff-Yeates | 96/1 C |
| 2,975,052 | 3/1961 | Fotland et al. | 96/1 TE |
| 3,398,336 | 8/1968 | Martel et al. | 96/1 C |
| 3,438,706 | 4/1969 | Tanaka et al. | 96/1.4 |
| 3,645,729 | 2/1972 | Goffe | 96/1 TE |
| 3,653,064 | 3/1972 | Inoue | 96/1 R |
| 3,676,117 | 7/1972 | Kinoshita | 96/1 R |
| 3,677,751 | 7/1972 | Ohta et al. | 96/1 R |
| 3,703,399 | 11/1972 | Tanaka et al. | 427/17 |

*Primary Examiner*—Roland E. Martin, Jr.
*Assistant Examiner*—John L. Goodrow
*Attorney, Agent, or Firm*—Fitzpatrick, Cella, Harper & Scinto

[57] ABSTRACT

This specification discloses an electrophotographic process for forming an electrostatic latent image on a photosensitive medium which may consist of an insulative layer and a photoconductive layer (and further an insulative layer), and also discloses an apparatus for carrying out the process. The electrophotographic process essentially comprises the primary charging step of uniformly charging the insulative layer of the photosensitive medium, and the step of contacting a liquid with said insulative layer and applying a desired voltage to the liquid to thereby discharge or charge the liquid and substantially simultaneously therewith, applying light from an object image to the photoconductive layer of the photosensitive medium. The process may further comprise other various steps as required in electrophotography, such as overall or blanket exposure, development, image transfer and cleaning of the photosensitive medium.

20 Claims, 20 Drawing Figures

ELECTROPHOTOGRAPHIC METHOD

This is a continuation, of application Ser. No. 317,783, filed Dec. 22, 1972, now abandoned.

BACKGROUND OF THE INVENTION

1. Field of the Invention

This invention generally relates to an electrophotographic method or process and an apparatus therefor. More particularly, it relates to a novel electrophotographic process which is less affected by environmental conditions during image reproduction than the conventional electrophotographic processes and can produce copy images of very high sensitivity and very high definition.

2. Description of the Prior Art

Applicant previously proposed various electrophotographic processes as disclosed in U.S. Pat. No. 3,438,706, U.S. Pat. No. 3,666,363, U.S. Pat. No. 3,666,365 and copending U.S. Application Ser. No. 563,899. These electrophotographic processes employed a photosensitive medium basically comprising a conductive back-up member, a photoconductive layer and an insulative layer, and involved the steps of pre-charging the surface of the outermost insulative layer of the photosensitive medium with positive polarity if the photoconductive layer is of N-type conductivity or with negative polarity if this layer is of P-type conductivity so that charges opposite in polarity to the charges in the surface of said insulative layer may be formed in the region adjacent the interface between the photoconductive layer and the insulative layer; thereafter applying light from an original image and AC corona discharge or DC corona discharge of the opposite polarity to that of the pre-charge simultaneously to the surface of the pre-charged insulative layer to thereby vary the charged condition of the photosensitive medium in accordance with the light-and-dark pattern of the original image; and then substantially uniformly exposing the entire surface of the insulative layer to light to thereby release the charges corresponding to the dark region of the original image which exist in the vicinity of the interface between the photoconductive layer and the insulative layer, thus forming on the surface of the photosensitive medium an electrostatic latent image of high contrast representing the original image. Further, such electrostatic latent image is developed into a visible image by means of a developer composed chiefly of charged toner particles, whereafter the visible image is transferred to paper or other transfer medium by utilization of an internal or an external field, and then the transferred image is heated and fixed by an infrared ray lamp or the like to provide an electrophotographic copy image. On the other hand, after the image transfer, the surface of the insulative layer of the photosensitive medium is cleaned to remove the residual charged toner particles therefrom so as to make the photosensitive medium ready for reuse.

In addition to such conventional processes, there are known further electrophotographic processes including that which employs a photosensitive layer of P.I.P. characteristic or which involves the step of simultaneous application of image light and discharge or charge.

In these electrophotographic processes, corona discharge was generally used as the means for discharging or charging the surface of the photosensitive medium substantially simultaneously with the application of original image light thereto to thereby form an electrostatic latent image. Such processes using the corona discharge are meritorious in that the means therefor is not in contact with the photosensitive medium, whereas they have numerous demerits that the corona discharge electrode is readily subject to contamination which in turn results in an irregular discharging or charging effect, that the intensity of the corona discharge is fluctuated with variations in the environmental conditions such as temperature, humidity, atomospheric pressure, etc., that the shadow of the corona discharge electrode may be projected on the photosensitive medium depending on the construction of the optical system in use, and that the use of a high voltage may cause dangers. Also, using corona discharge or charge during the simultaneous application of image light and discharge to speed up the above-described various electrophotographic processes would result in a limited discharging or charging effect because corona discharge has a relatively high discharge resistance, and if any means for increasing the applied voltage is adopted to realize the speed-up, the resultant electrostatic latent image may often have a reduced contrast. In the previous electrophotographic processes, the photoconductive layer is advantageously required to maintain its charge only during the discharging time, so that a photoconductive material of low resistance can be used to obtain a very high sensitivity, nevertheless the corona discharge employed for the discharging or charging to be effected simultaneously with the application of image light imposed limitations in reducing the discharging or charging time, and accordingly imposed limitations on the resistance of the available photoconductive material.

Further, where an electrostatic latent image is formed by using corona discharge to effect discharging or charging substantially simultaneously with the exposure to image light, the potential in the light region of the latent image is limited to the vicinity of the saturation potential of the corona charger in order to provide a sufficient contrast of the latent image. The saturation potential of a corona discharger is usually zero to several hundred volts of negative sign in case of AC corona discharge, and one thousand and several hundred volts to two thousand and several hundred volts in case of DC discharge, and any other saturation potential than these ranges could not be provided without using a control electrode or without using an AC corona discharge with a DC bias imparted thereto. AC corona discharge is generally employed for the purpose of discharging, but the use of AC corona discharge in a frequency range of 50 to 60 cycles would readily cause irregular discharging effect in these cycles.

In addition to the discharging or charging method which employs corona discharge, a method using an electrode has heretofore been proposed, whereas this method is very difficult to realize because the allowance for the clearance between the electrode and the photosensitive medium is very much limited. An excessive clearance would lead to irregular discharging effect and therefore, it is hardly possible especially to discharge a photosensitive medium in motion.

As has been noted above, the use of corona discharge during the step of simultaneous application of image light and discharging or charging in the electrophotographic processes including such step involves numerous disadvantages and problems which ought to be overcome.

SUMMARY OF THE INVENTION

The present invention provides a highly ideal electrophotographic process which overcomes all the above-noted problems satisfactorily. More specifically, the present invention enables the potential in the light region of an image to be reduced as desired or conversely to be increased from zero potential to several hundred volts, without being affected by any variation in the environmental conditions during the simultaneous application of image light and discharging or charging, thereby providing a finished electrostatic latent image with an ideal contrast and definition.

It is therefore a primary object of the present invention to provide an improved electrophotographic process and an apparatus therefor which can effect high-speed copying.

It is another object of the present invention to provide an improved electrophotographic process and an apparatus therefor which can produce copy image of very high sensitivity and definition without being affected by the environmental conditions during image reproduction.

It is still another object of the present invention to provide an improved electrophotographic process and an apparatus therefor which ensures the surface of a photosensitive medium to be positively exposed to light from an original image during the simultaneous application of the image light and discharging or charging.

It is yet another object of the present invention to provide an improved electrophotographic process and an apparatus therefor which ensures discharging or charging to be uniformly effected on the photosensitive medium.

It is a further object of the present invention to provide an improved electrophotographic process and an apparatus therefor which employs a low voltage or a grounded potential, instead of a high voltage, during the charging or discharging.

As has been briefly described with respect to the electrophotographic processes previously proposed by the same assignee, the electrophotographic process of the present invention comprises the steps of primary charging and thereafter effecting simultaneous application of image light and discharging to a photosensitive medium with a body of non-insulative liquid interposed between the photosensitive medium and means for effecting such step, the liquid being grounded or suitable potential applied thereto. Where the photosensitive medium comprises a photoconductive material such as ZnO or CdS of great "memory" characteristic which retains conductivity for a certain length of time even after the application of light has been ceased, the liquid may be applied thereto immediately after the exposure to image light. Generally speaking, a photosensitive medium comprising inorganic conductive particles has a great memory effect, but some organic semiconductors also have a great memory effect. Thereafter, the liquid is removed from the photosensitive medium, which is then subjected to overall exposure. Thus, the present invention provides a process which can use a liquid having a low resistance within the range of conductivity known in the field of the art to which the invention pertains, to thereby form an electrostatic latent image of uniform and high contrast in a short time.

The present invention also ensures good image reproduction to be achieved in such a system as intimate-contact exposure system wherein it is difficult to accomplish the simultaneous application of image light and corona discharge.

A better understanding of the present invention may be had from the following detailed description of some specific embodiments thereof taken in conjunction with the accompanying drawings.

DESCRIPTION OF THE PREFERRED EMBODIMENTS

Figure 1A:
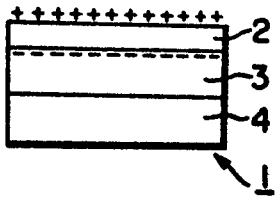
FIG. 1A, 1B and 1C illustrates the manner in which the arrangement of electric charges is changed in the electrophotographic process according to the present invention.
Figure 1B:
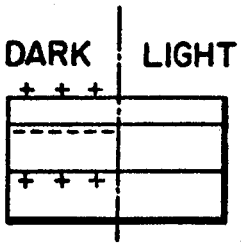

The process of forming an electrostatic latent image by using a photosensitive medium basically comprising an insulative layer, a photoconductive layer and a conductive layer is known from U.S. Pat. No. 3,438,706. In such electrophotographic process, the formation of an electrostatic latent image is accomplished by three steps as shown in FIG. 1. The photosensitive medium comprises three layers, i.e. an insulative layer 2, a photoconductive layer 3 and a conductive layer 4. During a first step as shown in FIG. 1A, the surface of the photosensitive medium 1 is charged with a polarity opposite to the polarity of majority carriers in the photoconductive layer 3. The majority carriers are introduced into the photoconductive layer 3 through the surface thereof adjacent the conductive layer 4 until they reach a region of the photoconductive layer 3 which is adjacent the interface between the layer 3 and the insulative layer 2. During a second step, as shown in FIG. 1B, the surface of the photosensitive medium 1 is exposed to image light and simultaneously therewith, subjected to discharging or charging.

Figure 1C:
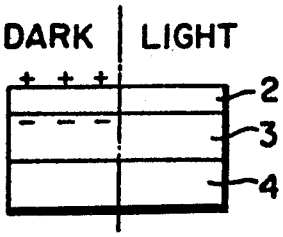

Since the discharging used herein is meant to substantially nullify the surface potential of the photosensitive medium 1, a distribution of charge density corresponding to the exposure to the image light is produced on the surface of the photosensitive medium. During a third step, as shown in FIG. 1C, the photosensitive medium 1 is subjected to a uniform exposure to thereby vary the charge distribution so that there is formed a latent image which can be extraneously detected as a surface potential variation, whereby the photosensitive medium is ready for subsequent step such as development or the like effected by charged toner particles. Here it should be noted that the surface potential should preferably be equal in value both in the light and dark regions when the second step of the simultaneous application of image light and discharging has taken place. With the discharging by the use of AC corona charge, the equalization of the surface potential is difficult because of the corona discharge resistance, and the light region which has more charge to be removed presents a higher potential. The potential difference existing between the light and the dark region at the end of the discharging leads to a loss of contrast. As such potential difference is smaller, a higher contrast may be obtained. In the second step described above, the surface potential of the photosensitive medium is equalized substantially simultaneously with the exposure to the image light, and this is useful to increase the contrast without disturbing the electrostatic latent image even if the discharging takes place in the presence of conductive liquid on the surface of the photosensitive medium. The conductive liquid must be removed prior to the third step of overall exposure because such liquid, if it should still remain on the photosensitive medium after the overall exposure, would act to nullify the surface potential difference already provided between the dark and the light region, that is, to disturb the latent image.

By reference to FIG. 2, the basic and essential operation of the present invention will now be described in relation to the use of a non-insulative liquid in the step of simultaneous application of image light and discharging which was described above with respect to FIG. 1.

Figure 2A:
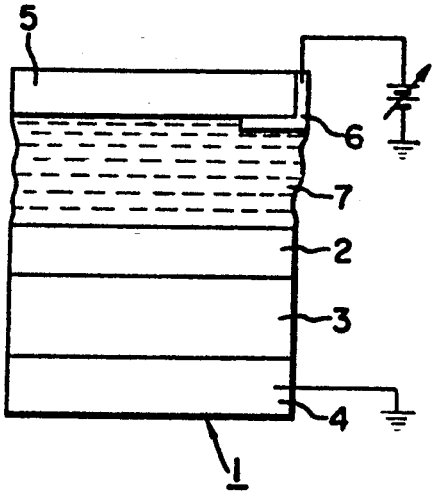
FIG. 2A and 2B illustrates the manner in which liquid is used during the simultaneous application of image light and discharging according to the present invention.
Figure 2B:
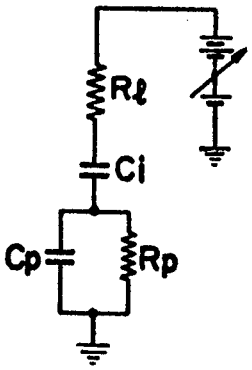

FIG. 2A illustrates the manner in which the discharging is effected simultaneously with the application of the image light, and FIG. 2B shows the equivalent circuit therefor. The non-insulative liquid 7 is present between the outermost insulative layer 2 of the photosensitive medium 1 and an optically transparent plate 5.

The plate 5 and the liquid 7 are optically homogeneous, transparent and free of light scattering characteristic, and if required, may be colored to provide a filter effect. Thus, these may be applicable to color electrophotography. The plate 5 may be formed of a material such as glass or plastics. Other material, for example, optical fiber may be used, but in such case the image light is of course focused on the surface of the optical fiber plate and not on the surface of the photosensitive medium, therefore the thickness of the layer of liquid 7 must be effectively smaller in accordance with a required resolving power, that is, a material of high refractive index is preferred. At least part of the liquid 7 must be in contact with a conductor 6 connected with a suitable potential, which is determined by the value of a potential selected as the potential in the light region of the latent image.

For instance, where the dry, magnetic-brush developing process is employed, some type of developer may provide a fogless, clear image by using in the light region a potential of 50 to 300 volts and of the opposite polarity to the potential in the dark region. Conversely, some other type of developer may provide an image of good tone reproductivity when the potentials in the light and dark regions are of the same polarity. This also holds true of the liquid developing process. In this way, a desired potential in the light region can be provided by changing the potential of the conductor 6 in accordance with the type of developer or developing process in use. Further, the poential with which the conductor is connected may be not only DC but also AC voltage, and in the latter case a bias voltage superimposed on zero or AC voltage provides a saturation potential.

Figure 3:
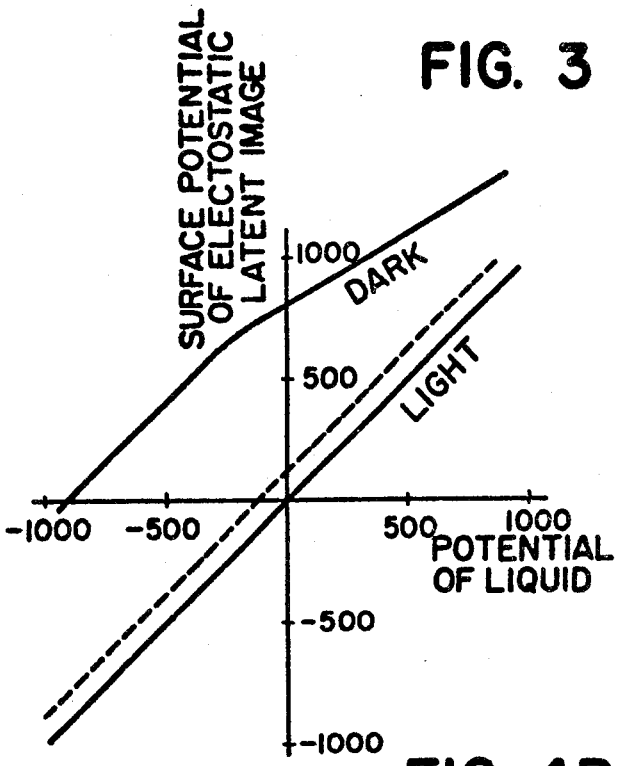
FIG. 3 is a graph illustrating the voltage applied to the liquid in FIG. 2 and the variation in the surface potential produced in the electrostatic latent image formed on the surface of the photosensitive medium by the applied voltage.

FIG. 3 graphically shows the correlations between the potential applied to the conductor 6 or to the liquid 7 and the surface potential of the electrostatic latent image resulting therefrom. In the graph, the abscissa represents the potential connected with the liquid and the ordinate represents the surface potential of the electrostatic latent image provided by the applied potential. These experimental data were obtained by using a photosensitive medium comprising an insulative layer of polyethylene terephthalate film having a thickness of 25 microns and a photoconductive layer of CdS particles dispersed in resin and by applying a primary charging voltage of +2000 volts. According to this example, the surface potential in the light region of the latent image is substantially in accord with the potential applied to the liquid, and especially in the case of a photosensitive medium having a residual potential or in the case of a somewhat reduced amount of exposure, the potential in the light region presents a value slightly higher than the potential applied to the liquid, as indicated by a dotted line. As will be seen from FIG. 3, the potential difference between the light and the dark of the image, i.e. the electrostatic constrast of the electrostatic latent image is increased by changing the liquid potential to the negative sign, but such increase comes to a halt at a certain stage where the withstand voltage of the photoconductive layer is reduced. This means that a relatively low contrast results when the liquid potential is of the same polarity as the primary charge and at a high level exceeding 500 volts and that when the liquid potential is of the opposite polarity and at a similar high level, the voltage applied to the photoconductive layer is increased to rapidly deteriorate such layer. Also, a so-called negative latent image will be provided if the potential in the light region is greater in absolute value than that in the dark region. When the voltage applied to the electrode is greater, care must be taken of the insulation from surrounding various devices. Thus, with the above-described developing characteristic taken into consideration, the potential applied to the liquid should preferably be at an absolute value below about 500 volts. The potential of the electrostatic latent image shown in FIG. 3 is merely illustrative, and such potential may of course be higher or lower than the shown level depending on the type of the photoconductive layer.

In the configuration as shown in FIG. 2, the potential of the conductor 6 may be varied so that it can also be used in the first step of charging.

Since, however, the charge potential resulting from the first step is usually as high as 1000 volts or higher, the insulation from the environment must be especially required and the presence of any electrically weak point such as pin-hole in a portion of the photosensitive medium would permit the current to flow intensively therethrough to damage the photosensitive medium and also change the charging capacity thereof. In view of these disadvantages, corona discharge is generally superior for use in the first step of charging.

The resistance required of the liquid 7 will now be considered in detail. This may be understood from the equivalent circuit shown in FIG. 2B. In this figure, R1 is the resistance of the liquid layer 7, Ci the electrostatic capacity of the insulative layer 2, Cp the electrostatic capacity of the photoconductive layer 3, and Rp the resistance of the photoconductive layer 3, the value of Rp being variable from the light region to the dark region. In a typical construction of the photosensitive medium 1, the values of these various factors per unit area may be: $Ci=1.1\times10^{-10}$ F/cm$^2$ for polyethylene terephthalate film of 25 micron thickness; $Cp=1.1\times10^{-10}$ F/cm$^2$ because the specific inductive capacity of resin-dispersed CdS layer having a thickness of 40 microns has been measured to be 5 or near; and Rp may be about $10^{12}\Omega$ cm for the dark region and about $10^{10}\Omega$ cm for the light region, although the property of the photosensitive medium cannot strictly be expressed in terms of simple resistance value. In this instance, the time constant of charging or discharging in the equivalent circuit of FIG. 2B would be Ci R1 for the light region (exposed region) of the image if the resistance Rp of the photoconductive layer in such region is regarded as sufficiently small, and the time constant would be Ci Cp R1/(Ci+Cp) for the dark region if the resistance Rp in such region is regarded as sufficiently great. In other word, the time constant of charging or discharging in the dark region is approximately one half of that in the light region. Sufficient discharging or charging must be done within a discharging or charging time preset for the machine construction, but 37% of the charge will remain unremoved if the charging or discharging time constant is equal to the discharging or charging time, 14% will remain if the former is one half of the latter, 5% will remain if the former is one-third of the latter, and a little less than 2% will remain if the former is one-fourth of the latter.

It has previously been noted that the time constant of charging or discharging for the light region is about twice that for the dark region, but the potential difference between the light and the dark regions should be reduced to provide a latent image of sufficiently high contrast. Thus, the time constant should desirably be one half or less of the charging or discharging time to obtain a latent image of sufficiently high contrast, although a latent image can anyhow be formed even if the time constant is equal to or little greater than the discharging or charging time. The charging or discharging time constant for the light region of the image is substantially Ci Rl and determined by the thickness of the liquid layer and the configuration of the conductor electrode 6, but in the configuration as shown in FIG. 2A the value of resistance Rl is complex and strictly, it differs from point to point in the conductor. The discharging or charging time is determined by the machine construction, and in an automatic machine using a drum-shaped photosensitive medium, for example, such time is determined by the peripheral speed of the drum and the width of contact of the liquid 7. In a typical case where the peripheral speed and the width of contact of the liquid 7 are 15 cm/sec. and 1.5 cm, respectively, the discharging or charging time is 0.1 sec. In order that the time constant may be 0.1 sec. or less, the photosensitive medium of the described type, if used, must have a resistance Rl equal to or less than $10^9\Omega$ cm$^2$. This is the value in case of the insulative layer 2 formed of a polyethylene terephthalate film having a thickness of 25 microns. The value of Rl is variable, as required, in accordance with the thicknss of the insulative layer 2 which is variable, for example, to 10 or 50 microns. It is seen, however, that such variation is only possible within several times or within the same order.

It is now believed that the necessary value of Rl has been understood. The specific resistance of the liquid 7 required to provide such value will be described below.

In FIG. 2A, it is assumed that the electrode 6 covers that surface of the plate 5 which faces the photosensitive medium 1. In such a case, the electrode 6 must be transparent and may be a thin evaporated film of tin oxide or other metal. If the thickness of the liquid layer 7 is d cm and the specific resistance of the liquid is $\phi\Omega$ cm, then the resistance value per cm$^2$ will be given by $\phi \times d\Omega$. From this, it is seen that, in order that Rl may be $10^9\Omega$ or less, the specific resistance of the liquid must be $10^{11}\Omega$ cm or less for $d=100\mu$ and $10^{10}\Omega$ cm or less for $d=1$ mm. This will agree with the result of the experiment. If this is to be formulated, the following relation must be established:

$$\phi \leqq t/Ci \cdot d \qquad (1),$$

where t is the discharging time. Basically, there is no lower limit of the resistance of the liquid. If, in FIG. 2A, discharging starts at the left end and terminates at the right end and if the electrode 6 is positionally limited to the vicinity of the right end (actually, the electrode may be located at any position where it can contact the liquid), the discharging will not so much progress at the right end portion but will abruptly take place only just below the electrode when the resistance of the liquid is increased to some extent, thereby enabling the essential discharging time to be reduced. For such purpose, the resistance of the liquid may preferably be selected to a great value within an allowable range.

The resistance of the liquid 7 may be of any value lower than $10^{11}\Omega$ cm, for example, and this means a very wide range of choice. Most simply, the liquid may be water. The water may be distilled water having a resistance of about $10^7\Omega$ cm or may be ordinary running water with impurities having a resistance of about $10^4\Omega$ cm, and these are sufficiently suitable for the purpose of the present invention. Water is also advantageous in that it is readily removable because polyethylene terephthalate, which may form the outermost insulative layer of the photosensitive medium, is difficult to be wet with water, and in that water is insoluble, if mixed, with liquid developer which may be used to develop a latent image formed by the process of the present invention, so that water is not deteriorative of the developer and is readily separable therefrom. Also, the surface of the photosensitive medium may recommendably be treated with a water-repulsive material such as Teflon or silicon rsin. Since the surface of the photosensitive medium is covered with a chemically stable, insulative layer, use may be made of even a liquid such as amorphous Se which would otherwise deteriorate the electrophotographic characteristic of a conventional photosensitive medium. Alcohol, having a specific resistance of $10^9\Omega$ cm, is also suitable for use. Although alcohol is said to expedite crystalization of amorphous Se, it can safely be used with such a photosensitive medium as employed with the present invention in which the surface of the amophous Se layer is covered with the insulative layer. Alcohol is better suited to fill a small clearance than water, because it is lower in surface tension and readier to wet numerous materials. Alcohol is also ready to dry up, if some of it fails to be removed. Use can also be made of any other liquid which has a sufficiently low resistance value, such as water with various electrolytes, propyl alcohol, many polar solvents, water with an interfacial activator, kerosene, a mixture of polar solvents, or a mixture of a nonpolar solvent and an additive. Depending on the intended purpose, a liquid composed of a solution of dye or similar coloring material may also be utilized. Where the liquid developing process is employed, the components of the developer used therefor may be used with very little harm caused even if a slight amount of them leaks and mixes with the developing liquid. For example, toner of the negative polarity may be provided by adding lecithin as interfacial activator to stabilize the polarity of the toner.

In such case, the liquid used for the discharging may consist of kerosene as the carrier of developer and lecithin added thereto at a density ten times higher than the density at which the liquid is used as developer. Since the increased density of lecithin provides a lower resistance of the liquid, leakage of such liquid may be reduced again and in some instances, the developing liquid for replenishment may contain no lecithin. The liquid, whose resistance has been reduced by mixing lecithin, propyl alcohol or the like with the kerosene which originally has a high resistance, is suitable for use where it is desired to use a liquid of high resistance (in the vicinity of $10^{11}\Omega$ cm, for example) within a range providing a sufficient discharging capacity. In addition to water, methyl alcohol or ethyl alcohol may be used as a conductive material which is insoluble to and readily separable from the developing liquid composed chiefly of kerosene. Propyl alcohol is readily soluble to kerosene.

In FIG. 2, a photosensitive medium of three layers has been shown to be used, but the present invention is equally applicable to a photosensitive medium of three insulative, photoconductive and insulative layers or of four layers including an additional layer of photoconductive material. In the latter case, however, introduction of carriers from the conductive layer does not occur even if the first step of charging is effected, and therefore, light may be applied during the first step of charging to thereby produce carriers and accordingly increase the contrast of the electrostatic latent image.

In the present instance, the equivalent circuit model described previously is such that the insulative layer represented by Ci comprises a serial connection of electrostatic capacities ($C_1$ and $C_2$) of two insulative layers, hence the time constant is $(C_1\ C_2)/(C_1+C_2)\times R1$, and accordingly, the limit of the specific resistance of the liquid is:

$$\phi \leqq t/(C_1C_2)/(C_1+C_2)d.$$

Also, in a system basically comprising an insulative layer and a photoconductive insulative layer, the primary charging may be done by a double corona discharger from the opposite sides of the photosensitive medium. In the step of applying non-insulative liquid substantially simultaneously with the exposure to image light, the back side of the photosensitive medium may be brought into contact with a conductive member such as conductive roller.

Some specific forms of the device for accomplishing the simultaneous application of image light and discharging will be described hereunder.

Figure 4A:
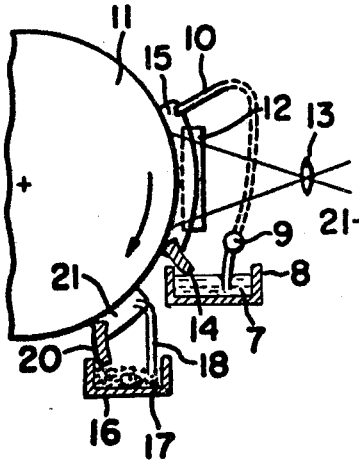
FIGS. 4A, 4B, 4B', 5, 6A, 6B, 7A, 7B, 8A, 8B, 9A, 9B, 10A, and 10B show various embodiments of the device for carrying out the simultaneous application of image light and discharging according to the present invention.

Referring to FIGS. 4A and B, non-insulative liquid 7 is normally supplied by a pump 9 from a liquid container 8 through a liquid supply pipe 10 to a photosensitive medium 11. The liquid so supplied is introduced into a clearance between the photosensitive medium 11 and a transparent plate 12 closely adjacent thereto due to the surface tension of the liquid and to the movement of the photosensitive medium (in the direction of arrow). If the liquid flows down along the surface of the photosensitive medium at a stable flow rate over the width thereof, the transparent plate may be eliminated.

A facility for discharging may be provided by making the transparent plate 12 or a later-described doctor blade 14 conductive and bringing them into contact with the supplied liquid, or by providing a separate conductor for contact with the liquid and grounding it or applying a suitable voltage thereto, so that discharging may be effected simultaneously with the application of image light which is effected through a projection lens 13. As noted previously, the supplied liquid must be removed from the surface of the photosensitive medium after the simultaneous application of image light and discharging but before the overall or blanket exposure step succeeding thereto, because such liquid would disturb the electrostatic latent image on the surface of the photosensitive medium if any part of it is residual thereon during the overall exposure. For this purpose, the liquid is substantially wiped off by the doctor blade 14 and collected into the liquid container 8 for cyclical reuse. Anti-leakage means 15 is provided to prevent the liquid from flowing out of the surface of the photosensitive medium during that while. Although this liquid may be substantially wiped off by the doctor blade 14, more complete removal of the liquid may be ensured by supplying hygroscoping particles 16 (sized 10 to 20 microns) from a downstream-located particle container 17 through a particle supply pipe 18 into a liquid absorbing chamber 19. Thereafter, those particles which have absorbed the liquid may be collected into the particle container 17 by a doctor blade 20. In the particle container 17, means (such as heater) is provided to dry the wet particles which have absorbed the liquid. The doctor blade 20 has on the opposite sides thereof means 21 for preventing leakage of particles.

Figure 4B:
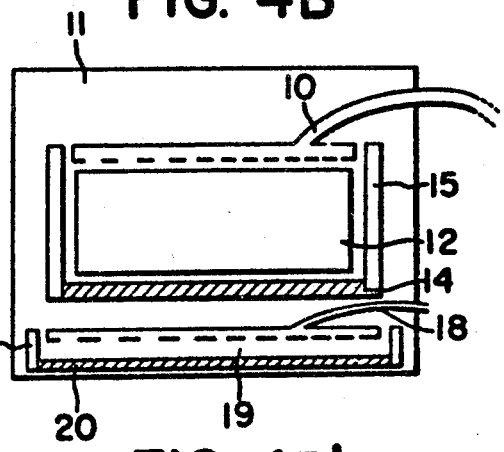
Figure 4B:
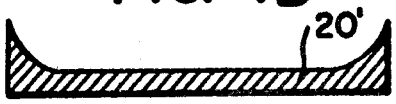

An alternative form of the doctor blade 20 with particle-leakage preventing means 21 is shown by 20′ in FIG. 4B′.

Figure 5:
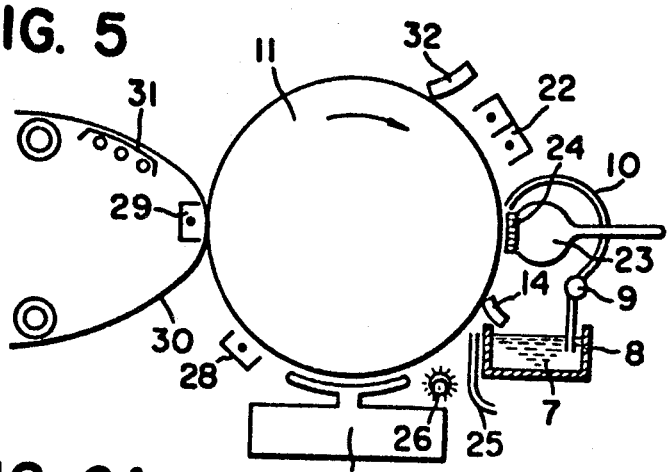

FIG. 5 shows an embodiment in which the application of image light to be effected simultaneously with the discharging is accomplished by use of a cathode ray tube and development is effected by means of liquid. The photosensitive drum, designated by 11, is rotated in the direction of the arrow. The surface of the photosensitive drum 11 is uniformly charged by a primary charger 22, whereafter the cathode ray tube 23 applies image light and suitable potential simultaneously with the liquid 7 supplied by the pump 9 into the clearance between the photosensitive drum and the cathode ray tube from the liquid container 8 through the liquid supply pipe 10. The cathode ray tube 23 for the simultaneous application of image light and discharging may be provided with a fiber plate 24 on the image-exposing face thereof. The application of the potential to the liquid may be done with the fiber plate covered with a conductive coating or with the liquid removing doctor blade 14 treated for conductivity. After the simultaneous application of image light and discharging, the liquid is wiped off by the doctor blade 14 and collected into the liquid container 8. Since a slight amount of liquid remains on the surface of the photosensitive drum even after liquid removal by the doctor blade, such residual liquid is thereafter dried by air blown from a drier 25. The air may be at room temperature or may be heated. Thereafter, overall exposure is effected by overall exposure means 26, then development is done by a liquid developing device 27, and any further residual liquid is squeezed out by a post-charger 28, whereafter the developed image is transferred onto a transfer medium 30 by a corona transfer device 29 and heated and fixed by a heating-fixing device 31. Subsequently, the surface of the photosensitive medium is cleaned for reuse by a cleaning blade 32.

Figure 6A:
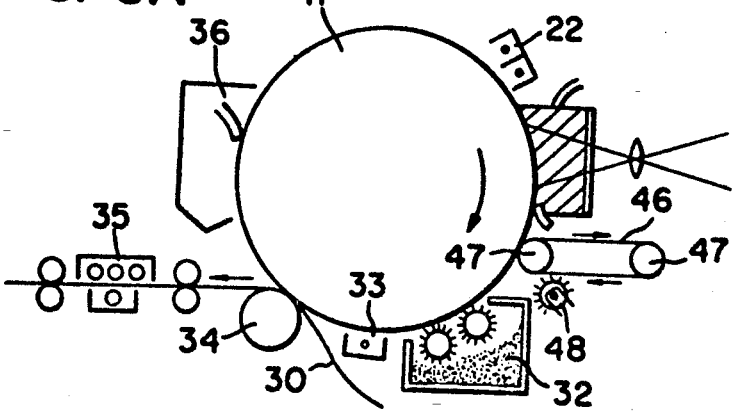
Figure 6B:
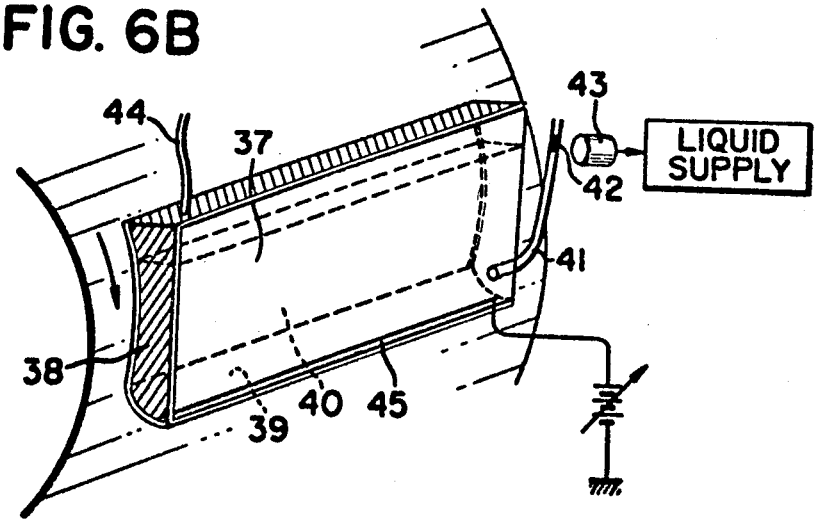

FIGS. 6A and B show a further embodiment in which a liquid-layer forming chamber is provided for the device for the simultaneous application of image light and discharging. In FIG. 6A, there are photosensitive medium 11, primary charger 22, wet type developing device 32 using a magnetic brush or the like, post-charger 33 and image transfer roller 34 for transferring a developed image onto transfer medium 30. The transfer roller 34 may be simply urged against the photosensitive drum or may further have a voltage applied thereto. Numeral 35 designates the heating-fixing device for fixing the transferred image on the transfer medium. Thereafter, the photosensitive medium is cleaned for reuse at a cleaning station 36. In the arrangement described just above, the station for the simultaneous application of image light and discharging will more particularly be described with reference to FIG. 6B. As shown there, there is provided a liquid-layer forming box which comprises a transparent plate 37 for enabling the application of image light, plates 38 for preventing leakage of liquid, a doctor blade 39 for removing the liquid, and a surface 40 of the photosensitive medium 11. A liquid-layer detector tube 41 extends into the liquid-layer forming box and has a float 42 movably inserted therein. A detector 43 is provided to measure the level of the liquid within the box in accordance with the upward or downward movement of the float 42 in the detector tube 41. When the quantity of the liquid in the liquid-layer forming box is reduced, a suitable amount of liquid is supplied thereinto through a liquid supply pipe 44. An electrode wire 45 is attached to the blade so that any desired voltage (including a grounded condition) may be applied thereto to discharge or charge the liquid. Thus, with the device of FIG. 6, the liquid in the liquid-layer forming box is always maintained at a constant quantity to thereby ensure ideal simultaneous application of image light and discharging or charging. Further, the quantity of the liquid may be adjusted in accordance with the desired copying conditions, thus enabling good image reproduction. In FIG. 6A, numeral 46 designates an endless belt formed of fibrous material having a good hygroscopic property and entrained on rollers 47, the belt 46 being normally moved round to wipe off any amount of liquid overflown from the said station for the simultaneous application of image light and discharging. The liquid absorbed by the hygroscopic belt is heated and dried by a lamp designated at 48. The lamp 48 may be provided individually or may be common with the lamp used for the overall exposure of the photosensitive medium surface in the electrophotographic process of the present invention.

Figure 7A:
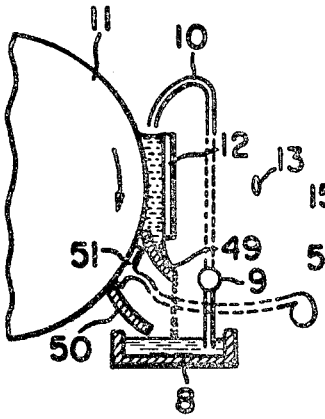
Figure 7B:
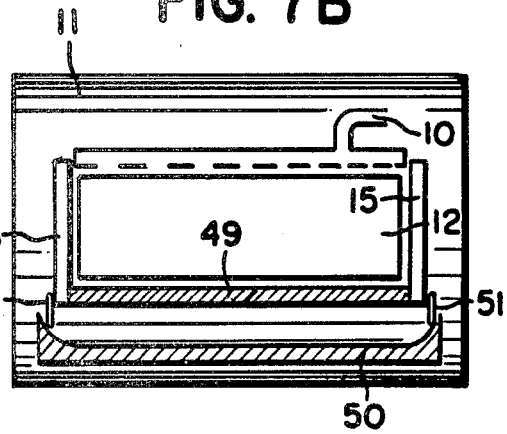

FIG. 7 shows another embodiment in which liquid is supplied from the liquid container 8 through the pump 9 and liquid supply pipe 10 so as to form a liquid layer always between the transparent plate 12 and the surface of the photosensitive medium, and the liquid is dually wiped off by a first blade 49 and a second blade 50. In this instance, the second blade 50 is formed with a curvature so as to facilitate the collection of the removed liquid. Preferably, the curved portions of this blade may be disposed outwardly of the width over which the exposure to the image light take place, thereby providing a uniform width of the discharging or charging effected by the liquid. The portion of the liquid overflown from the first blade would undesirably flow out from the opposite sides of the second blade as the latter blade is removing the liquid. To avoid this, an air nozzle, indicated as at 51, is provided to blow air therethrough so as to direct the liquid from the opposite sides of the second blade toward the center thereof to thereby prevent outflow of the liquid. The liquid thus removed is thereafter collected for reuse in the liquid container.

Figure 8A:
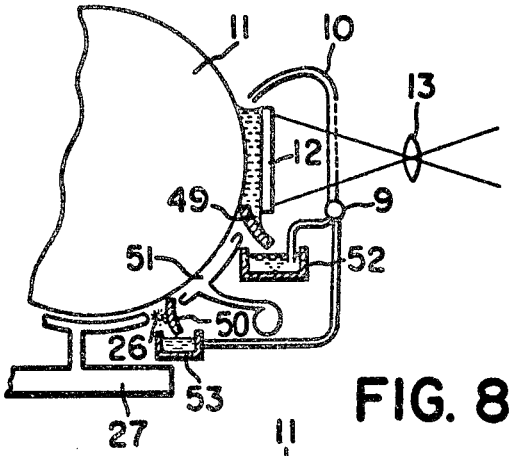
Figure 8B:
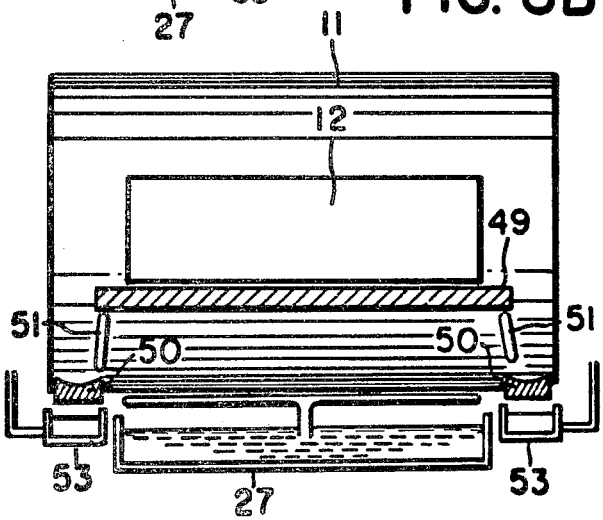

FIG. 8 illustrates a further embodiment in which the liquid supplied into the clearance between the transparent plate and the surface of the photosensitive medium through the pump 9 and liquid supply pipe 10 is wiped off by a first blade 49 and then collected into a first liquid container 52 and any further residual liquid is free to flow out of the opposite sides of the transparent plate and collected by a second blade 50 into a second liquid container 53, so that the liquid thus stored in the first and second liquid containers can be reused. In the present instance, an air nozzle 51 is provided to form an air curtain which prevents the liquid from the first to the second blade from flowing into the developing device. Numerals 26 and 27 designate the overall exposure means and the liquid developing device, respectively.

Figure 9A:
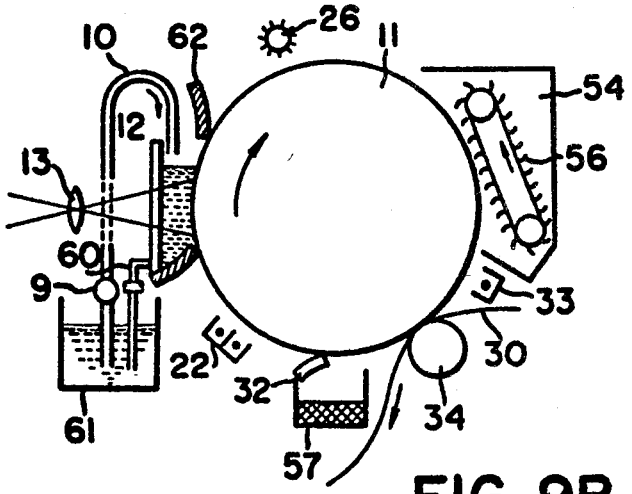
Figure 9B:
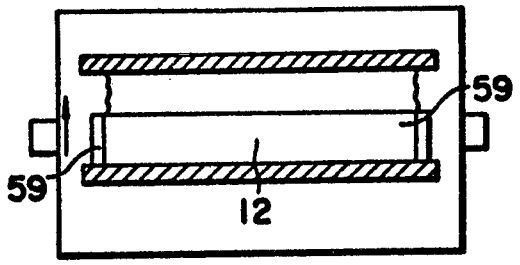

FIG. 9 shows a modification of the embodiments shown up to FIG. 8, in which the photosensitive medium 11 is rotated in the opposite or upward direction relative to the device for the simultaneous application of image light and discharging. Numeral 22 designates the primary charger. Provided downstream of the means for the simultaneous application of image light and discharging are overall exposure means 26 and developing device 54, successively. The developing device 54 includes an endless belt provided with a number of brackets 56 for cascading the developer. After development, the photosensitive medium is post-charged at 33 and then the image is transferred to the transfer medium 30 by the transfer roller 34, whereafter the photosensitive medium is cleaned for reuse by the blade 36. Numeral 57 designates the developer container. In the station for the simultaneous application of image light and discharging, there is provided a liquid-layer forming box which comprises a combination of the surface of the photosensitive medium, transparent member 12, lower blade 58 and outflow preventing means 59 provided on the opposite sides of the blade, and liquid downflow pipe 60 extends downwardly from the liquid-layer forming box into a liquid container 61 for collecting the liquid. Liquid supply pipe 10 extends upwardly from within the liquid container 61 to supply liquid into the liquid-layer forming box. Liquid is always circulated by the pump 9. After the simultaneous application of image light and discharging, the liquid is brought back into the liquid-layer forming box by the blade 62.

Figure 10A:
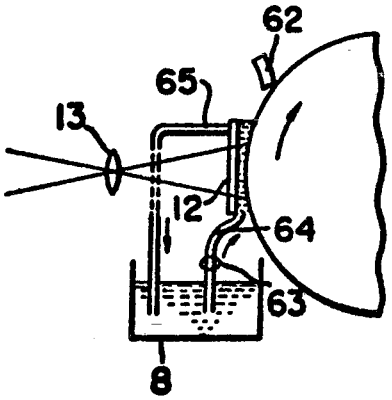
Figure 10B:
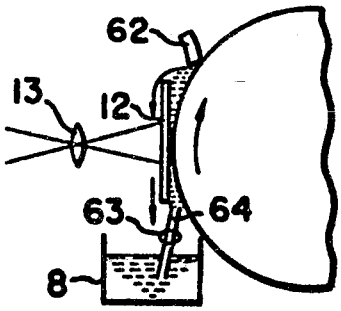

FIGS. 10A and B show further embodiments in which the photosensitive medium is rotated in the same direction as in FIG. 9, relative to the device for the simultaneous application of image light and discharging. Liquid is supplied from the liquid container 8 through the pump 63 and liquid supply pipe 64 into the clearance between the transparent plate 12 and the surface of the photosensitive medium 11. Thus, the liquid forms a liquid layer with the aid of the rotation direction of the photosensitive drum. The liquid overflown from the upper edge of the transparent plate is passed through liquid discharge pipe 65 into the liquid container 8 for collection and reuse. Any amount of liquid remaining on the surface of the photosensitive medium after the simultaneous application of image light and discharging is wiped off by the blade 62. In the embodiment of FIG. 10B, the discharge pipe as shown in FIG.

10A is eliminated and the outflow of liquid is guided downwardly along the surface of the transparent plate. Thus, both surfaces of the transparent plate are always cleaned to maintain a maximum transparency. At this stage, the liquid may be somewhat contaminated, but it is readily possible to maintain the liquid in an ideal state by employing means such as filter 66 of filtering paper, sponge, metallic screen, fabric or like material before the liquid is supplied from the liquid container to the surface of the photosensitive medium. As compared with the embodiment of FIG. 9, the embodiments shown in FIGS. 10A and B reduce the number of the blades which frictionally contact the surface of the photosensitive medium, thus reducing the possible damages imparted to the photosensitive medium.

Numerous embodiments of the device for accomplishing the simultaneous application of image light and discharging in the electrophotographic process of the present invention have been shown and described, and any of these embodiments enables the electrophotographic process of the present invention to be carried out in an ideal manner. The effects of the electrophotographic process according to the present invention will now be described.

According to the present invention, charging or discharging is effected by the use of non-insulative liquid and this ensures good image reproduction to be achieved without being affected by the environmental conditions such as the atmosphere during the copying operation. In addition, the potential in the light region of a latent image can be controlled to any desired value by applying any desired voltage to the liquid, thus providing a latent image of optimum potential in accordance with the type of the developing method or the developer in use. Heretofore, the use of corona discharge in the step of the simultaneous application of image light and discharging tended to cause a reduced contrast of the resultant image when the copying speed was increased, whereas the present invention enables latent images of high contrast to be provided even at very high speeds. The use of corona discharge also caused the saturation potential and discharge potential to be fluctuated with the applied voltage and environmental conditions, but according to the present invention the saturation potential is the potential of the electrode which is free of fluctuation and if required, may be selected to any desired value. Further, the sufficiently low discharge resistance would never adversely affect the latent image even if it is fluctuated at all.

Moreover, the present invention permits a low voltage to be used with the liquid, thus completely eliminating any danger which would otherwise result from the use of a high voltage as when corona discharge is used.

In the past, there was known a process of forming an electrostatic latent image by displacing charges through liquid. In the known process, however, the liquid was insulative and contained therein a dope material for carrying charges. The insulativeness of the liquid was required because, if the liquid was conductive, neutralization of latent image would progress during the removal of the liquid after the formation of such image and even during such formation itself, thus resulting in the production of very indefinite image. Thus, the known process is fundamentally different from the present invention in that the insulative property of the liquid limits the rate at which charges are applied, which in turn hampers rapid formation of latent images.

We claim:

1. An electrophotographic process for forming an electrostatic latent image on a photosensitive medium having an insulative layer and an underlying photoconductive layer, said process comprising:

the primary charging step of uniformly charging said insulative layer;

the step of contacting a non-insulative liquid with said insulative layer and applying a desired voltage to said liquid to thereby discharge or charge said insulative layer and simultaneously therewith or immediately therebefore, applying light from an original image to said photoconductive layer, wherein said liquid satisfies the relation $\rho \leqq t/Ci \cdot d$, where $\rho$ is the specific resistance of said liquid, Ci is the electrostatic capacity of said insulative layer, d is the thickness of the layer of said liquid, and t is the discharging or charging time; and the step of removing said non-insulative liquid from said insulative layer and then effecting overall exposure on said photoconductive layer.

2. An electrophotographic process according to claim 1, wherein said primary charging step is effected by a corona charger.

3. An electrophotographic process according to claim 1, wherein said primary charging step is effected by applying a desired voltage to the non-insulative liquid in conact with said insulative layer.

4. An electrophotographic process according to claim 1, wherein a DC voltage opposite in polarity to the primary charge is applied to said liquid.

5. An electrophotographic process according to claim 1, wherein a grounded voltage is applied to said liquid.

6. An electrophotographic process according to claim 1, wherein an AC voltage with a DC voltage superimposed thereon is applied to said liquid.

7. An electrophotographic process according to claim 1, wherein a DC voltage of the same polarity as the primary charge but lower than the voltage of the primary charge is applied to said liquid.

8. An electrophotographic process according to claim 1, wherein an AC voltage is applied to said liquid.

9. An electrophotographic process for forming an electrostatic latent image on a photosensitive medium having a first insulative layer, a photoconductive layer and a second insulative layer, said process comprising:

the primary charging step of uniformly charging said first insulative layer;

the step of contacting a non-insulative liquid with said first insulative layer and applying a desired voltage to said liquid to thereby discharge or charge said insulative layer and simultaneously therewith or immediately therebefore, applying light from an original image to said photoconductive layer, wherein said liquid satisfies the relation $\rho \leqq t(C_1+C_2)/C_1 \cdot C_2 \cdot d$, where $\rho$ is the specific resistance of said liquid, $C_1$ and $C_2$ are the electrostatic capacities of said insulative layers, d is the thickness of said liquid, and t is the discharging or charging time; and the step of removing said non-insulative liquid from said first insulative layer and then effecting overall exposure on said photoconductive layer.

10. An electrophotographic process according to claim 9, wherein said primary charging step is effected by a corona charger.

11. An electrophotographic process according to claim 9, wherein said primary charging step is effected by applying desired voltage to the liquid in contact with said first insulative layer.

12. An electrophotographic process according to claim 9, wherein a DC voltage opposite in polarity to the primary charge is applied to said liquid.

13. An electrophotographic process according to claim 9, wherein a grounded voltage is applied to said liquid.

14. An electrophotographic process according to claim 9, wherein an AC voltage with a DC voltage superimposed thereon is applied to said liquid.

15. An electrophotographic process according to claim 9, wherein a DC voltage of the same polarity as the primary charge but lower than the voltage of the primary charge is applied to said liquid.

16. An electrophotographic process according to claim 9, wherein an AC voltage is applied to said liquid.

17. An electrophotographic process for forming an electrostatic latent image on a photosensitive medium having an insulative layer and an underlying photoconductive layer, said process comprising:

the primary charging step of uniformly charging said insulative layer;

the step of contacting a non-insulative liquid with said insulative layer and applying a desired voltage to said liquid to thereby discharge or charge said insulative layer and simultaneously therewith or immediately therebefore, applying light from an original image to said photoconductive layer, wherein said liquid satisfies the relation $\rho \leqq t/Ci \cdot d$, where $\rho$ is the specific resistance of said liquid, Ci is the electrostatic capacity of said insulative layer, d is the thickness of the layer of said liquid, and t is the discharging or charging time;

the step of removing said non-insulative liquid from said insulative layer and then effecting overall exposure on said photoconductive layer; and the step of developing the electrostatic latent image.

18. An electrophotographic process for forming an electrostatic latent image on a photosensitive medium having an insulative layer and an underlying photoconductive layer, said process comprising:

the primary charging step of uniformly charging said insulative layer;

the step of contacting a non-insulative liquid with said insulative layer and applying a desired voltage to said liquid to thereby discharge or charge said insulative layer and simultaneously therewith or immediately therebefore, applying light from an original image to said photoconductive layer, wherein said liquid satisfies the relation $\rho \leqq t/Ci \cdot d$, where $\rho$ is the specific resistance of said liquid, Ci is the electrostatic capacity of said insulative layer, d is the thickness of the layer of said liquid, and t is the discharging or charging time;

the step of removing said non-insulating liquid from said insulative layer and then effecting overall exposure on said photoconductive layer;

the step of developing the electrostatic latent image;

the step of transferring the developed image to a transfer medium;

the step of fixing the transferred image on said transfer medium; and the step of cleaning the surface of said photosensitive medium after said image transfer has been done.

19. An electrophotographic process for forming an electrostatic latent image on a photosensitive medium having a first insulative layer, a photoconductive layer and a second insulative layer, said process comprising:

the primary charging step of uniformly charging said first insulative layer;

the step of contacting a non-insulative liquid with said first insulative layer and applying a desired voltage to said liquid to thereby discharge or charge said insulative layer and simultaneously therewith or immediately therebefore, applying light from an original image to said photoconductive layer, wherein said liquid satisfies the relation $\rho \leqq t(C_1+C_2)/C_1 \cdot C_2 \cdot d$, where $\rho$ is the specific resistance of said liquid, $C_1$ and $C_2$ are the electrostatic capacities of said insulative layers, d is the thickness of said liquid, and t is the discharging or charging time;

the step of removing said non-insulative liquid from said first insulative layer and then effecting overall exposure on said photoconductive layer; and the step of developing the electrostatic latent image.

20. An electrophotographic process for forming an electrostatic latent image on a photosensitive medium having a first insulative layer, a photoconductive layer and a second insulative layer, said process comprising:

the primary charging step of uniformly charging said first insulative layer;

the step of contacting a non-insulative liquid with said first insulative layer and applying a desired voltage to said liquid to thereby discharge or charge said insulative layer and simultaneously therewith or immediately therebefore, applying light from an original image to said photoconductive layer, wherein said liquid satisfies the relation $\rho \leqq t(C_1+C_2)/C_1 \cdot C_2 \cdot d$, where $\rho$ is the specific resistance of said liquid, $C_1$ and $C_2$ are the electrostatic capacities of said insulative layers, d is the thickness of said liquid, and t is the discharging or charging time;

the step of removing said non-insulative liquid from said first insulative layer and then effecting overall exposure on said photoconductive layer;

the step of developing the electrostatic latent image;

the step of transferring the developed image to a transfer medium;

the step of fixing the transferred image on said transfer medium; and the step of cleaning the surface of said photosensitive medium after said image transfer has been done.

* * * * *

UNITED STATES PATENT AND TRADEMARK OFFICE

CERTIFICATE OF CORRECTION

PATENT NO. : 4,222,776

DATED : September 16, 1980

INVENTOR(S) : SYUSEI TSUKADA, ET AL.

It is certified that error appears in the above-identified patent and that said Letters Patent are hereby corrected as shown below:

Column 7, line 55, change "thicknss" to --thickness--.

Column 8, line 41, change "rsin" to --resin--.

Column 14, line 27, change "conact" to --contact--.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*